US005158667A

United States Patent [19]

Barlow et al.

[11] Patent Number: 5,158,667

[45] Date of Patent: Oct. 27, 1992

[54] METHODS FOR INHIBITING FOULING IN FLUID CATALYTIC CRACKING UNITS

[75] Inventors: Raymon C. Barlow, Conroe; Dwight K. Reid, Houston, both of Tex.

[73] Assignee: Betz Laboratories, Inc., Trevose, Pa.

[21] Appl. No.: 749,034

[22] Filed: Aug. 23, 1991

[51] Int. Cl.[5] ..... C10G 9/16

[52] U.S. Cl. ..... 208/48 AA; 44/335; 585/950

[58] Field of Search ..... 208/48 AA, 251 R; 44/335; 585/950

[56] References Cited

U.S. PATENT DOCUMENTS

| | | | |
|---|---|---|---|
| 4,200,518 | 4/1980 | Mulvany | 208/48 AA |
| 4,647,290 | 3/1987 | Reid | 44/57 |
| 4,744,881 | 5/1988 | Reid | 208/48 |
| 4,749,468 | 6/1988 | Roling et al. | 208/251 R |
| 4,810,354 | 3/1989 | Roling et al. | 208/48 AA |
| 4,867,754 | 9/1989 | Reid | 44/72 |

*Primary Examiner*—Theodore Morris
*Assistant Examiner*—William C. Diemler
*Attorney, Agent, or Firm*—Alexander D. Ricci; Philip H. Von Neida

[57] ABSTRACT

This invention relates to processes for inhibiting fouling in fluid catalytic cracking units. The processes comprise adding to the hydrocarbon being processed a polymer formation inhibiting amount of aminoethyl piperazine.

3 Claims, No Drawings

METHODS FOR INHIBITING FOULING IN FLUID CATALYTIC CRACKING UNITS

FIELD OF THE INVENTION

The present invention pertains to methods for inhibiting the fouling of fluid catalytic cracking units that are processing hydrocarbon and slurry streams.

BACKGROUND OF THE INVENTION

Fouling of equipment in fluid catalytic cracking (FCC) units can significantly affect unit operation by reducing the necessary transfer of heat in heat exchangers, by restricting unit throughput due to increased pressure drop and, in general, by reducing the overall operating efficiency of the production unit.

A loss in heat transfer can result in increased fuel costs to operate the unit or may affect product separation when the lost heat cannot be replaced by other means. The physical restriction of flow can cause production limitations due to increased pressure drop in the system. Pluggage in the separation towers can also restrict necessary separation efficiencies and subsequent product separation. The overall unit performance can be adversely affected, even when the flexability of unit operations exists to compensate for the effects of fouling.

FCC unit feedstocks are generally the heavier fractions from the upstream processing units. In those heavier gas oils, resids and other feeds, non-volatile, inorganic fouling materials tend to concentrate. As the fluids flow through the system, the individual smaller particles of the contaminants can agglomerate and form larger particles. Catalyst fines from the reaction process can be entrained in product streams and will contribute to inorganic foulants. Eventually, the settling velocity of the particles becomes higher than the local system velocity, and the particles settle out. They will settle first in the low-velocity portions of the system, such as the baffles, bends, and the trays of the tower. However, when other types of fouling, such as organic fouling, have already occurred, the rate of agglomeration can increase, thereby depositing the particles on other parts of the system.

The chemical composition of organic foulants is rarely identified completely. Organic fouling is caused by insoluble polymers which are sometimes degraded to coke. The polymers are usually formed by reactions of unsaturated hydrocarbons, although any hydrocarbon can polymerize. Generally, olefins tend to polymerize more readily than aromatics, which in turn polymerize more readily than paraffins. Trace organic materials containing hetero atoms such as nitrogen, oxygen and sulfur also contribute to polymerization.

Polymers can be formed by free radical chain reactions. These reactions, shown below, consist of three phases: an initiation phase, a propagation phase and a termination phase. Chain initiation reactions (1 a), (1 b), and (1 c) give rise to free radicals, represented by R. (The symbol R. can be any hydrocarbon).

Such chain reactions can be initiated by (1 a) heating a reactive hydrocarbon (e.g. olefin) to produce free radicals and (1 b), (1 c) the production of free radicals from an unstable hydrocarbon material via metal ions.

During chain propagation, additional free radicals are formed and the hydrocarbon molecules (R) grow larger and larger (see Reaction 2 a).

Through the termination phase free radical reactions are destroyed into nonradical products (3a, 3b, 3c). If free radicals are not destroyed, continued radical transfer leads to the formation of unwanted polymers.

As polymers form, more polymers begin to adhere to the heat transfer surfaces. This adherence results in dehydrogenation of the hydrocarbon and eventually the polymer is converted to coke.

Chain initiation a. $R{-}H \rightarrow R. + H.$ b. $Me^{++} + RH \rightarrow Me^{+} + R. + H^{+}$ c. $Me^{++} + ROOH \rightarrow Me^{+} + ROO. + H^{+}$ 2. Chain Propagation a. $R. + \overset{|}{C}{=}\overset{|}{C}(R) \longrightarrow R.{-}\underset{|}{C}{-}\underset{|}{C}.$ b. $R. + O_2 \longrightarrow R{-}O{-}O.$ c. $R{-}O{-}O. + R'{-}H \longrightarrow R. + R{-}O{-}H$ d. $R{-}O{-}O. + \overset{|}{C}{=}\overset{|}{C} \longrightarrow ROO{-}\underset{|}{C}{-}\underset{|}{C}.$ 3. Chain Termination a. $R. + R. \rightarrow$ nonradical products b. $R. + R{-}O{-}O. \rightarrow$ nonradical products c. $R{-}O{-}O. + R{-}O{-}O. \rightarrow$ nonradical products The adhesive properties of formed polymers increase the chance of large particle formation. Further, polymers depositing on hot equipment, such as heat exchanger tubes at temperatures from 650° F. to 1000° F., can serve as "binders" for all sizes of particulate contaminants.

Another way that leads to polymerization is the oxygen contamination of feedstocks. Research indicates that even very small amounts of oxygen can cause or accelerate polymerization. (See reactions 2b, 2c, 2d). Accordingly, antioxidant-type antifoulants have been developed to prevent oxygen from initiating polymerization. Antioxidants act as chain-stoppers by forming inert molecules with the oxidized free radical hydrocarbons in accordance with the following reaction:

Chain Termination $RO_2. + AH \rightarrow RO_2H + A.$ $A. + RO_2 \rightarrow$ inert products $2A. \rightarrow$ inert products Surface modifiers or detergents change metal surface characteristics to prevent foulants from depositing. Dispersants or stabilizers prevent insoluble polymers, coke and other particulate matter from agglomerating into large particles which can settle out of the process stream and adhere to the metal surfaces of process equipment. They also modify the particle surface so that polymerization cannot readily take place.

Traditional feedstocks can be classified according to their tendencies to accommodate free radical polymer formation. The most reactive types are those containing olefinic materials, then aromatic compounds and then saturated hydrocarbons, which although they are unlikely to polymerize, when exposed to high temperatures and thermal cracking can yield compounds that will readily polymerize.

Straight-chain materials containing multiple bonds (olefins) react readily with oxygen to form the free-radical polymerization precursors which contribute to the rapid chain propagation process. At the higher temperatures within a fluid catalyst cracking unit, the chain initiation and propagation steps are enhanced.

Another mechanism responsible for polymer formation and fouling is the contacting of free metals with the feedstock. The metals do not react with the hydrocarbon but act as polymerization catalysts. The metals which are organically bound in the hydrocarbon stream provide a catalytically active site at which the chain propogation reaction is promoted. Typically, the transition metals show the greatest catalytic activity. The order of reactivity relative to the feedstock is olefins, aromatics, and then straight chain hydrocarbons. Metal - catalyzed polymerization is also accelerated at elevated temperatures.

The product transferred out of the reactor as vapor contains a small quantity of catalyst fines. These fines will accumulate in the slurry oil (bottoms) of the main fractionator. In addition to fractionator fouling, fouling will also occur in the slurry system.

Dispersants have some clean-up and fouling prevention ability in a slurry system if enough is used. In most situations, polymer is a significant constituent of fouling. These deposits will eventually degrade to coke-like deposits which are extremely tenacious. In situations like this, clean-up by dispersant may not be effective and some form of mechanical cleaning need be performed.

Antifoulants are designed to prevent equipment surfaces from fouling. They are not designed to clean up existing foulants. Therefore, an antifoulant should be started immediately after equipment is cleaned. It i usually advantageous to pretreat the system at double the recommended dosage for two or three weeks to reduce the initial high rate of fouling immediately after startup.

The increased profit possible with the use of antifoulants varies from application to application. It can include an increase in production, fuel savings, maintenance savings and other savings from greater operating efficiency.

SUMMARY OF THE INVENTION

The present invention pertains to inhibiting the fouling of fluid catalytic cracking units due to the formation of polymers during the processing of hydrocarbons. More specifically, the present invention pertains to the use of aminoethyl piperazine to inhibit fouling of fluid catalytic cracking units during the processing of hydrocarbon streams, particularly slurry streams.

DESCRIPTION OF THE RELATED ART

U.S. Pat. No. 4,647,290, Reid, Mar. 1987 discloses processes and compositions for color stabilized distillate fuel oils. The processes employ adding to the fuel oil a composition of N-(2-aminoethyl) piperazine and N,N-diethylhydroxylamine.

U.S. Pat. No. 4,867,754, Reid, Sep. 1989 teaches processes and compositions for inhibiting deterioration of distillate fuel oil employing a composition of a phosphite compound and a tertiary amine compound. 2-(aminoethyl) piperazine can be utilized in this composition.

U.S. Pat. No. 4,744,881, Reid, May 1988 discloses methods and compositions for controlling fouling during the processing of a hydrocarbon having a bromine number less than 10. The compositions provide for a non-hindered or partially hindered phenol and an organic amine. Exemplary amines include N-(2-aminoethyl) piperazine.

DETAILED DESCRIPTION OF THE INVENTION

Generally, the present invention relates to methods for inhibiting the formation of polymers and the subsequent fouling of equipment surfaces in a fluid catalytic cracking unit during the processing of hydrocarbons comprising adding to said hydrocarbons an effective amount for the purpose of aminoethyl piperazine.

The compound of the present invention will act to inhibit fouling throughout the fluid catalytic cracking unit but is found to be most effective in the main fractionator bottom (slurry) stream. Historically, the slurry pumparound is the worst fouler in a fluid catalytic cracking unit. The slurry is used as a pumparound stream to improve product separation.

It is thought that the fouling that occurs in the slurry is due to the reaction of certain carbonyl compounds and pyrrole nitrogen compounds. These reactions form higher molecular weight condensation polymers which will eventually deposit on equipment surfaces and foul the fluid catalytic cracking unit.

The compound of the present invention can also be effectively used with other antifoulants such as polybutynyl thiophosphoric acid ester and N,N'-disalicylidene-1,2-cyclohexanediamine.

The treatment dosage range for the aminoethyl piperazine compound clearly depends upon the severity of the fouling problem, the condensation polymers being formed and the strength of the concentrate used. For this reason, the success of the treatment is totally dependent upon the use of a sufficient amount for the purpose of the aminoethyl piperazine. Broadly speaking, the aminoethyl piperazine can be added in a range from about 5 parts to about 5000 parts per million parts of hydrocarbon sought to be treated. Preferably, from about 15 parts to about 200 parts per million parts of hydrocarbon is employed.

The aminoethyl piperazine may be added as a concentrate or as a solution using a suitable carrier solvent which is compatible with the aminoethyl piperazine and the hydrocarbon stream. Suitable carrier solvents include heavy aromatic naphtha and xylene (a commercial mixture of o, m, and p isomers).

In order to more clearly illustrate this invention, the data set forth below was developed. The following examples are included as being illustrations of the invention and should not be construed as limiting the scope thereof.

EXAMPLES

In order to establish the efficacy of the inventive concept, the hot filament fouling procedure test was performed. The test procedure utilized was as follows:

In a glass reaction vessel, equipped with a metal stirring blade, a thermocouple, a reflux condenser, and a nichrome wire (0.51 mm thick and 95 mm long) designated Chromel A mounted between two brass rods 50 mm apart, were placed 500 grams of slurry. A heating mantle was used to heat the slurry to 450° F. with stirring. When this temperature was reached, the additive, if any, was added and the mixture stirred 30 minutes. Power (6–8 amps, 2.1–2.2 volts; this amount varying depending on the feedstock) was then applied to the wire. After the power was on for one (1) hour, the temperature of the reaction mixture was 650° F., which stayed at about this temperature for the next 23 hours. At the end of 24 hours, the power was turned off and the reaction mixture was cooled to 230° F., the wire removed, washed carefully and thoroughly with xylene, allowed to dry, and weighed. The results of this testing is presented in Tables I, II and III.

TABLE I

| | Hot filament fouling test 8 amps at 2.2 volts 200 psi $N_2$ initial purge | |
|---|---|---|
| Treatment | Dosage (ppm) | Deposit (mg) |
| Blank | 0 | 2628 |
| A | 1000/1000 | 1375 |

Treatment A is aminoethyl piperazine and polybutynyl thiophosphoric acid ester in heavy aromatic naphtha.

TABLE II

| | Hot filament fouling test 8 amps at 2.1 volts 200 psi $N_2$ initial purge | |
|---|---|---|
| Treatment | Dosage (ppm) | Deposit (mg) |
| Blank | 0 | 7412 |
| B | 1000/500/500 | 4785 |

Treatment B is polybutynyl thiophosphoric acid ester, aminoethyl piperazine and N,N'-disalicylidene-1,2-cyclohexanediamine.

TABLE III

| | Hot filament fouling test 6 amps at 2.1 volts 200 psi $N_2$ initial purge | |
|---|---|---|
| Treatment | Dosage (ppm) | Deposit (mg) |
| Blank | 0 | 1887 |
| C | 500 | 1045 |

Treatment C is aminoethyl piperazine in heavy aromatic naphtha.

The results reported in Table III indicate that aminoethyl piperazine, alone, is surprisingly effective at inhibiting the formation and deposition of fouling materials in slurries. Further, as indicated in Tables I and II, the compound of the present invention is also efficacious at inhibiting fouling when combined with other antifoulants.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention what we claim is:

1. A method for inhibiting the formation of polymers and the subsequent fouling equipment surfaces in a fluid catalytic cracking unit during the processing of hydrocarbon slurry streams at a temperature of 650° F. to 1000° F. comprising adding to said streams from about 5 to about 5000 parts per million parts of said stream of aminoethyl piperazine contained in an organic solvent and polybutynyl thiophosphoric acid ester.

2. The method as claimed in claim 1 wherein said aminoethyl piperazine is added in an amount from about 15 parts to about 200 parts per million parts of said hydrocarbon.

3. The method as claimed in claim 1 wherein said organic solvent is heavy aromatic naphtha.

* * * * *